US005409235A

United States Patent [19]

Ameri

[11] Patent Number: 5,409,235

[45] Date of Patent: Apr. 25, 1995

[54] PYRAMID GAME

[76] Inventor: Victor Ameri, 89 Locust Ave., Mill Valley, Calif. 94941

[21] Appl. No.: 267,126

[22] Filed: Jun. 28, 1994

[51] Int. Cl.[6] ..... A63F 3/00

[52] U.S. Cl. ..... 273/242; 273/261; 273/288

[58] Field of Search ..... 273/242, 260, 261, 264, 273/288, 291

[56] References Cited

U.S. PATENT DOCUMENTS

| | | | |
|---|---|---|---|
| 287,352 | 10/1883 | Ward . | |
| 722,668 | 3/1903 | Bennett . | |
| 943,435 | 12/1909 | Marris . | |
| 1,161,649 | 11/1915 | Fitzgerald | 273/260 |
| 1,658,503 | 2/1928 | Vincent | 273/260 |
| 3,048,404 | 8/1959 | Tebbs . | |
| 3,608,902 | 9/1971 | Weisbecker . | |
| 3,608,906 | 9/1971 | Odier . | |
| 3,638,947 | 2/1972 | Hardesty . | |
| 3,706,456 | 12/1972 | Sesti et al. . | |
| 3,887,190 | 6/1974 | Ameri . | |
| 4,339,136 | 7/1982 | Gittings | 273/260 X |
| 5,014,995 | 5/1991 | Woodward | 273/261 |

FOREIGN PATENT DOCUMENTS

| | | | |
|---|---|---|---|
| 105410 | 10/1938 | Australia | 273/261 |
| 324361 | 9/1902 | France | 273/261 |
| 3214 | of 1902 | United Kingdom | 273/261 |
| 620529 | 3/1949 | United Kingdom | 273/261 |

*Primary Examiner*—William E. Stoll

*Attorney, Agent, or Firm*—Phillips, Moore, Lempio & Finley

[57] ABSTRACT

A board game includes a board divided into a multiplicity of contiguous, equally-sized, equilateral triangles, half of them colored as to be visually distinguishable from the other half, and arranged in an alternated sequence of colors, and a plurality of playing members associated therewith, the ratio of playing members to triangles being 12 to 54, there being two visually distinguishable sets of such members. Each playing member is of four-sided configuration, each side defining a triangle congruent with each board triangle. The movement of each member takes place by rotating that piece about a board triangle leg until the piece is seated on a board triangle contiguous with the first-mentioned board triangle.

2 Claims, 2 Drawing Sheets

PYRAMID GAME

BACKGROUND OF THE INVENTION

This invention relates to a board game and, more particularly, to a game played on a board defining a plurality of triangles, half of them black and half of them white, and played with a plurality of pieces having triangular sides.

The object of the present invention is a board game that may be played by two players competing against each other. Competitive games of this type include games such as checkers or chess, wherein the playing members have set or defined moves over a game board.

The skill and strategy involved in positioning the playing pieces, wherein they are, of course, moved within the limitations of the game, are of prime importance.

Of general interest in this area are U.S. Pat. No. 722,668 to Bennett, U.S. Pat. No. 943,435 to Marris, U.S. Pat. No. 3,048,404 to Tebbs, U.S. Pat. No. 3,608,902 to Weisbecker, U.S. Pat. No. 3,608,906 to Odier, U.S. Pat. No. 3,638,947 to Hardesty, and U.S. Pat. No. 3,887,190 to Victor Ameri, 1975.

SUMMARY OF THE INVENTION

It is an object of this invention to provide a game apparatus including a marked board and a plurality of playing members associated therewith.

It is a further object of this invention to provide a game apparatus which, while fulfilling the above object, includes playing members each of which has four sides of triangular configuration, and a playing board wherein the markings define a plurality of triangles (half of them black and half of them white) thereon.

Broadly stated, the invention herein comprises a game apparatus comprising a board having markings thereon defining a plurality of equilateral, congruent board triangles, each being contiguous on at least one side with another triangle.

Further included are a plurality of four-sided playing members, each side of each playing member defining an equilateral triangle congruent with the triangle defined by each other side of that member, and congruent with the triangle defined by each side of each other playing member, and congruent with each of the plurality of board triangles, each member having a triangular side positioned on a board triangle to cover and conform to that board triangle.

Each member is movable by rotation of that member generally about one leg of a board triangle on which that member is positioned, that leg being common to that board triangle and an unoccupied board triangle contiguous therewith, until another triangular side of the member is seated on the contiguous board triangle to cover and conform to that contiguous board triangle.

BRIEF DESCRIPTION OF THE DRAWINGS

These and other objects of the invention will become apparent from a study of the following specifications and drawings, in which.

DESCRIPTION OF THE PREFERRED EMBODIMENTS

Figure 1:
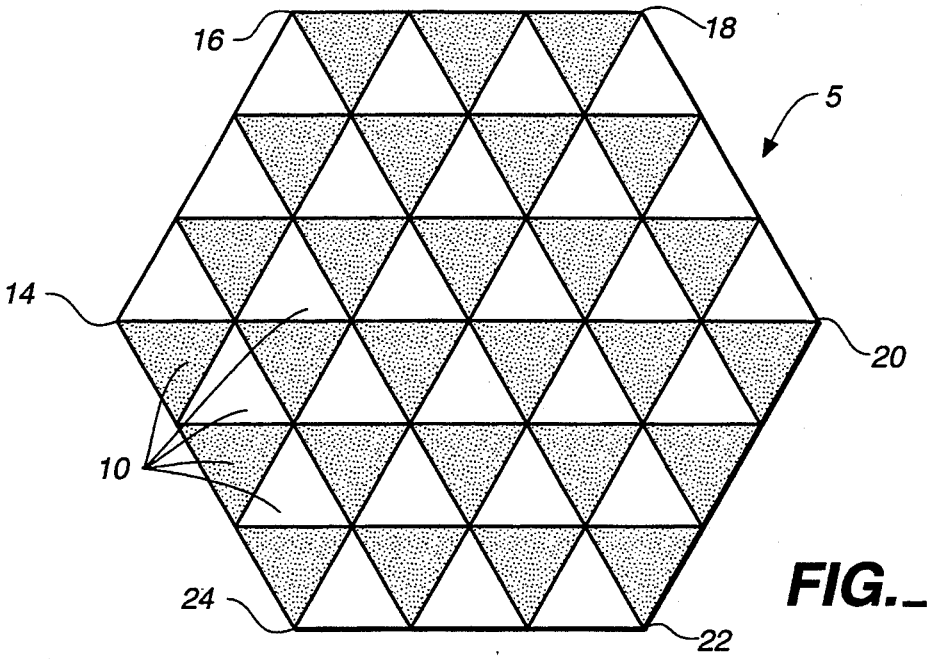
FIG. 1 is a plan view of the board of the game apparatus.

FIG. 1 shows the preferred embodiment of playing board 5 of the game apparatus. The board is marked with a plurality of lines so as to define a plurality of equilateral, congruent board triangles 10, half of them one color, preferably black, and half of them a second, contrasting color, preferably white.

The overall configuration of these markings is hexagonal, having six corners 14, 16, 18, 20, 22, and 24. Each of the external triangles of the board 10 is contiguous on two sides with other board triangles, and each internal board triangle (i.e., not having a leg defining part of the overall hexagon) is contiguous on all three sides with other board triangles. In the present embodiment, there are 54 board triangles, half of them black and half of them white.

Figure 2:
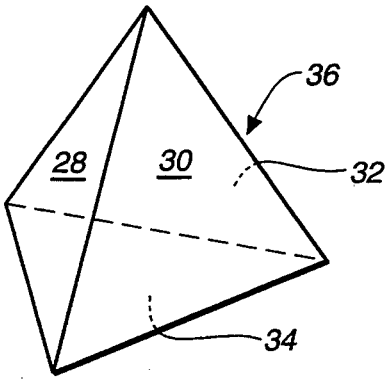
FIG. 2 is a perspective view of a playing member of the game apparatus.

Twelve playing members, each in the shape of a tetrahedron, one of which is shown at FIG. 2, are included as part of the game apparatus. The playing member 36 (FIG. 2) has four sides 28, 30, 32 and 34, each side defining an equilateral triangle congruent with the triangle defined by each other side thereof. It will be understood that each of the remaining playing members is shaped in the same manner, so that the triangle defined by each side of the member is congruent with the triangle defined by each side of each other member. In addition, the triangle defined by each side of each playing member is congruent with each of the board triangles.

In the use of the game apparatus (see FIG. 4), six of the playing members are of one color, such as white, and six are of a second, contrasting color, such as black, so as to be distinguishable. That is, pieces 36, 38, 40, 42, 44 and 46 are colored white and are manipulated by one player, while pieces 48, 50, 52, 54, 56 and 58 are black and are manipulated by the opponent player.

Figure 4:
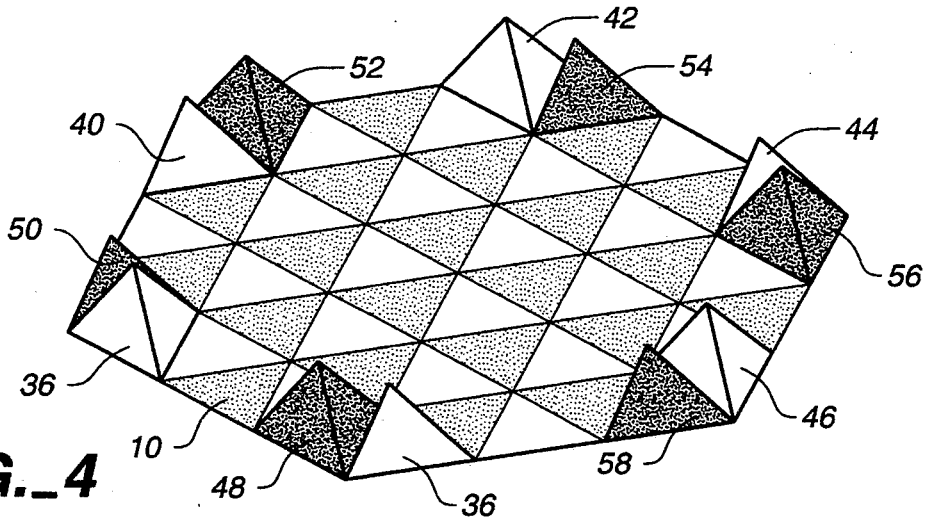
FIG. 4 is an overall perspective view of the board and playing members, showing the situation of the playing members at the beginning of the game; and, FIGS. 5 and 6 are two views of the playing members in winning positions.

In starting the game, the playing members are positioned on the outer row of triangles that define the edge of the board, and conform to the corners of the overall hexagon that is at the apices of the hexagonal board in the spaces thereof. In this manner, the adjacent white and black pieces are on alternate colored triangles. Further, as shown in FIG. 4, the white and black members alternate such that adjacent members are of a different color.

One triangular side of each member covers and conforms to a board triangle 10.

Figure 3:
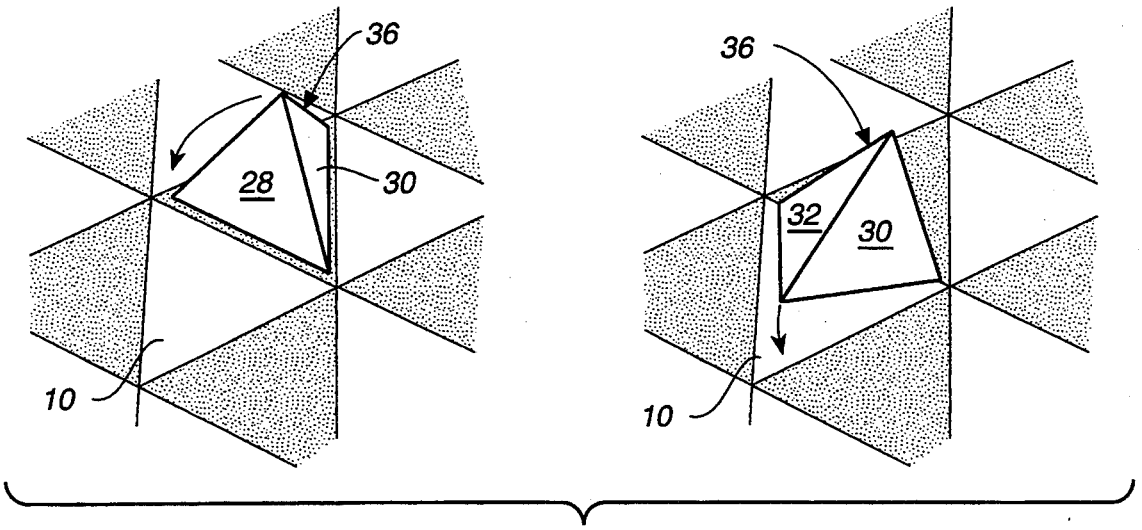
FIG. 3 are perspective views of a portion of the board and a playing member, illustrating the movement of the playing member on the board.

The player manipulating the white members moves first, and may move one white member, for example, member 36, in the manner shown in FIG. 3. That is, the member 36 shown as an example is movable by rotation thereof generally about one leg of a board triangle 10 on which that member is positioned, that leg being common to that board triangle and an unoccupied board triangle 10 contiguous therewith. The member is rotated until another triangular side thereof (in this case, side 28) is seated on the contiguous board triangle 10 to cover and conform to that contiguous board triangle 10. Playing member 36 can be considered to be movable by rotation of that member generally about one leg of the triangle defined by the side of the member positioned on the playing surface of the board into an unoccupied area of the board until another triangular side is seated on the playing surface of the board.

A playing member that enters a black triangle of the board, in merit of the playing rules of the game, has the option to move the same playing member again in the manner above described, or stay put.

Figure 5:
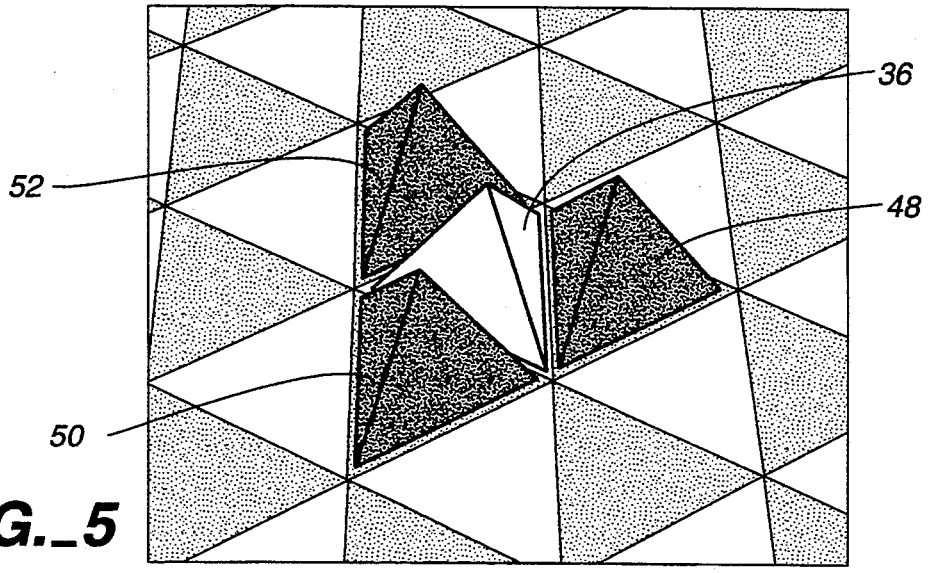
Figure 6:
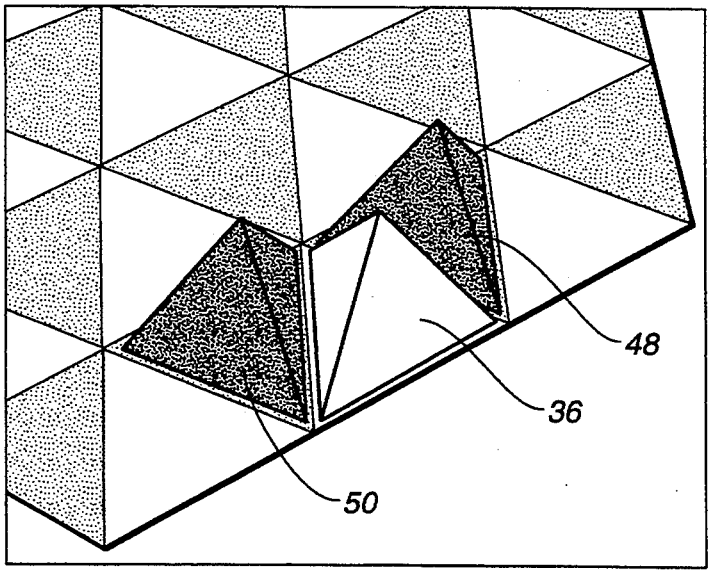

The moves continue until the object of the game is realized, which is that stage wherein one member, such as member 36, or more of the playing members is completely surrounded by opponent members so it (or they) cannot move (FIG. 5), or is pinned against the edge of the board so it (or they) cannot move (FIG. 6).

It will therefore be understood that, in accordance with the playing rules of the game, strategic planning and tactics are necessary to achieve the positions that win the game, and to defend against them.

What is claimed is:

1. A method of playing a board game where the game apparatus includes a board having markings thereon defining a plurality of 54 equilateral congruent board triangles, half of a first board color and half of a second contrasting board color, each being contiguous on at least two sides with other board triangles; said plurality of triangles defining an hexagonal configuration, and twelve four-sided playing members in the shape of a regular tetrahedron, each side of each playing member defining an equilateral triangle, and each side of each playing member congruent with the triangle defined by each side of each other playing member, and congruent with each of the plurality of the board triangles, and wherein there are twelve playing members six of a first playing member color being distinguishable from the remaining six of a second contrasting playing member color; the method of play comprising the following steps;

a. Positioning the twelve four-sided playing members at the apices of the board such that the six playing members of one color alternate with the six playing members of the other playing member color;

b. Commencing play by rotating one of the playing members about one of the playing member edges contiguous with the board so that the playing member is made congruent with an adjacent unoccupied board triangle;

c. Continuing play by rotating a second playing member of the second playing member color about one of the second playing member edges contiguous with the board so that the playing member is made congruent with an adjacent unoccupied board triangle;

d. Continuing play by alternating steps B and C, while maneuvering the playing members until one of the playing members is constrained from further movement by immediately adjacent playing members of the contrasting playing member color;

e. Declaring the winner of the game as the player that is preventing the movement of the playing member of the other contrasting playing member color.

2. The method as set forth in claim 1 further including the step of permitting a second play if the playing member just moved has been rotated onto a board triangle of the second contrasting board color.

* * * * *